US012168585B2

(12) United States Patent
Satake

(10) Patent No.: US 12,168,585 B2
(45) Date of Patent: Dec. 17, 2024

(54) PAPER FEED DEVICE AND IMAGE FORMING APPARATUS INCLUDING PAPER FEED DEVICE

(71) Applicant: TOSHIBA TEC KABUSHIKI KAISHA, Tokyo (JP)

(72) Inventor: Naoki Satake, Izunokuni Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 343 days.

(21) Appl. No.: 17/684,971

(22) Filed: Mar. 2, 2022

(65) Prior Publication Data

US 2022/0402713 A1 Dec. 22, 2022

(51) Int. Cl.

| | |
|---|---|
| ***B65H 3/06*** | (2006.01) |
| ***B65H 1/12*** | (2006.01) |
| ***B65H 1/14*** | (2006.01) |

(52) U.S. Cl.

CPC ..... *B65H 3/0676* (2013.01); *B65H 1/12* (2013.01); *B65H 1/14* (2013.01); *B65H 2402/30* (2013.01); *B65H 2403/544* (2013.01); *B65H 2801/06* (2013.01)

(58) Field of Classification Search

CPC ..... B65H 1/14; B65H 2405/11151

See application file for complete search history.

(56) References Cited

U.S. PATENT DOCUMENTS

| | | | | |
|---|---|---|---|---|
| 8,783,677 | B2 * | 7/2014 | Matsushima | B65H 1/14 271/147 |
| 10,173,852 | B2 * | 1/2019 | Yamaguchi | B41J 11/00 |
| 2013/0161894 | A1 | 6/2013 | Ishikawa et al. | |
| 2014/0125005 | A1 | 5/2014 | Matsushima et al. | |
| 2020/0130968 | A1 * | 4/2020 | Solders | B65H 1/14 |

FOREIGN PATENT DOCUMENTS

| | | |
|---|---|---|
| JP | H04-12424 U | 1/1992 |
| JP | H11-49382 A | 2/1999 |

* cited by examiner

*Primary Examiner* — Howard J Sanders
(74) *Attorney, Agent, or Firm* — Kim & Stewart LLP

(57) ABSTRACT

According to an embodiment, a paper feed device includes: a tray that has a support surface on which a sheet is placed and is capable of entering a first state and a second state. The first state is a state for placing the sheet on the support surface. The second state is a state for taking out the sheet from the support surface toward a downstream side in a conveying direction and for putting the sheet in an inclined posture heading upward on the downstream side in the conveying direction than an upstream side in the conveying direction.

4 Claims, 18 Drawing Sheets

PAPER FEED DEVICE AND IMAGE FORMING APPARATUS INCLUDING PAPER FEED DEVICE

CROSS-REFERENCE TO RELATED APPLICATIONS

This application is based upon and claims the benefit of priority from the prior Japanese Patent Application No. 2021-103238, filed on Jun. 22, 2021, the entire contents of which are incorporated herein by reference.

FIELD

An embodiment to be described here generally relates to a paper feed device and an image forming apparatus including this paper feed device.

BACKGROUND

In the past, an image forming apparatus includes a cassette for printing an image. A sheet in the cassette is conveyed to an image forming unit in the image forming apparatus and printing is performed by the image forming unit. Since the cassette is usually located in the lower part of the image forming apparatus, the capacity for housing sheets is limited. In this regard, there is known a paper feed device having a large capacity, which is additionally disposed on the side of the image forming apparatus. In this paper feed device, a large amount of sheets are placed on a tray. The paper feed device lifts the tray upward to lift the sheet to a paper feed unit of the image forming apparatus. The paper feed unit feeds the sheets one by one to the image forming unit by a roller.

In the image forming apparatus, the tray is lifted upward while being substantially-horizontal. While the sheet is lifted to the paper feed unit, the orientation in which the sheets are caused to enter a nip formed between the paper feed roller and a separation roller is substantially horizontal. In particular, there is a problem that in the case where the sheet is relatively thick, the sheet is easily jammed. As a countermeasure to this problem, a pickup roller that takes out the sheet from the tray is urged downward to increase the frictional force between the pickup roller and the sheet. In the case where the sheet is relatively thin, the sheets are double-fed, i.e., a plurality of sheets is easily taken out at the same time.

DETAILED DESCRIPTION

Figure 1:
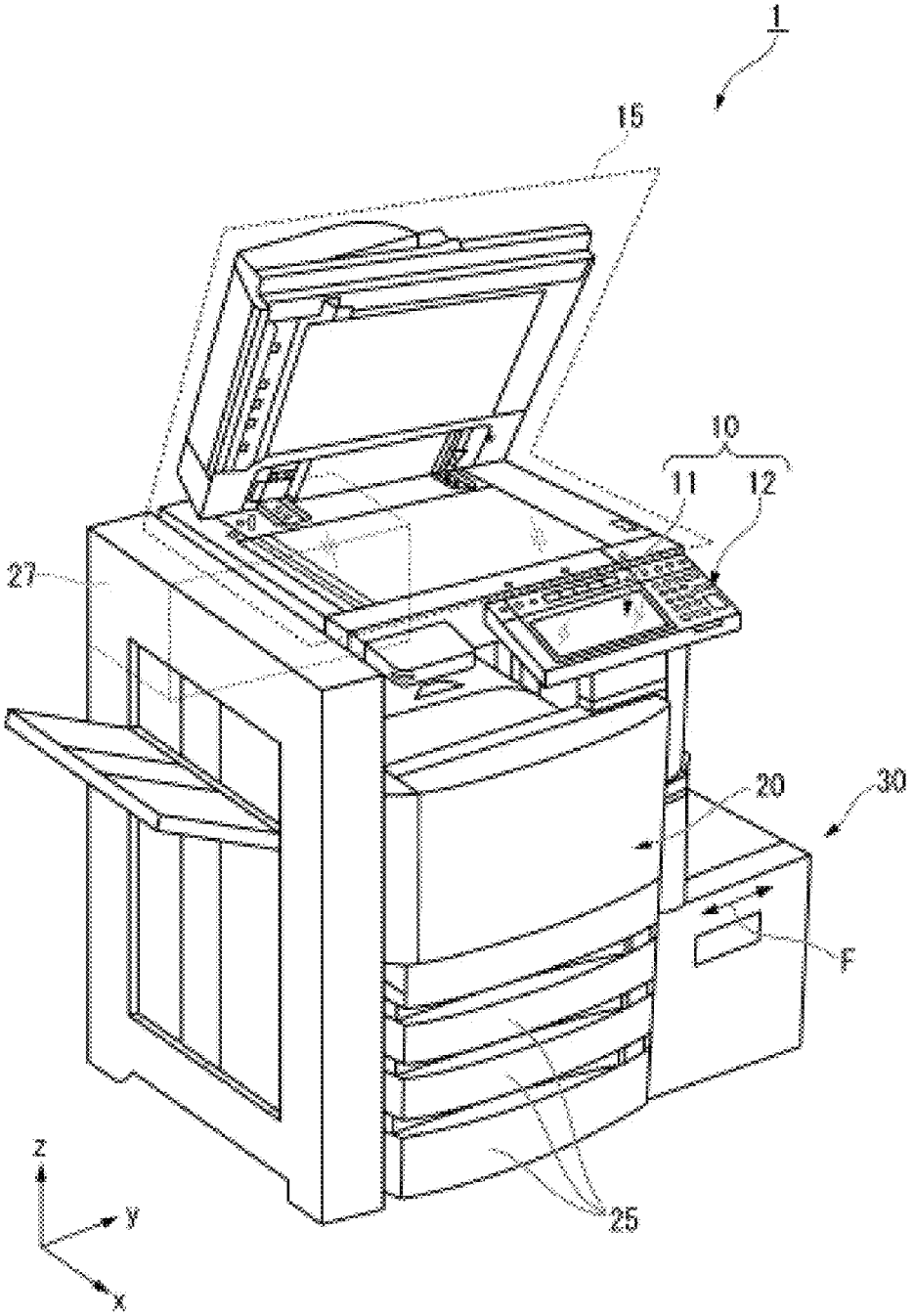
FIG. 1 is a perspective view showing a configuration example of an image processing apparatus including a paper feed device according to a first embodiment.

According to an embodiment, a paper feed device includes: a tray; a first roller; a second roller; and a third roller. The tray has a support surface on which a sheet is placed and is capable of entering a first state and a second state. The first state is a state for placing the sheet on the support surface. The second state is a state for taking out the sheet from the support surface toward a downstream side in a conveying direction and for putting the sheet in an inclined posture heading upward on the downstream side in the conveying direction than an upstream side in the conveying direction. The first roller takes out the sheet from the tray to the downstream side in the conveying direction. The second roller conveys the sheet taken out by the first roller to the downstream side in the conveying direction. The third roller is provided to face the second roller and forms a nip sandwiching the sheet between the third roller and the second roller. An angle between a reference line and the sheet on the support surface of the tray in the second state is smaller than an angle between the reference line and the sheet on the support surface of the tray in the first state, the reference line connecting a contact position and the nip to each other, the first roller being in contact with the sheet at the contact position.

First Embodiment

A paper feed device according to a first embodiment will be described with reference to the drawings. In the drawings, the same reference symbols denote the same or similar portions. The paper feed device is used in an image processing apparatus 1 shown in FIG. 1. The image processing apparatus 1 includes, for example, a multifunction device (MFP, Multi-Function Peripherals). The image processing apparatus 1 includes an operation device 10, a scanner device 15, a printer device 20, a cassette paper feed device 25, a controller 27, and a paper feed device 30 according to this embodiment. The image processing apparatus 1 forms an image on a sheet using a developer such as toner. Examples of the sheet used in the image processing apparatus 1 include paper, label paper, a resin sheet, a postcard, and an envelope. The type of the sheet (paper type) is not limited as long as the image processing apparatus 1 is capable of forming an image on the surface of the sheet. For example, the thin sheet described herein means a sheet having a weight of 80 $g/m^2$ or less. The thick sheet described herein means a sheet having a weight of 81 $g/m^2$ or more.

The image processing apparatus 1 may perform image processing on the sheet. For example, the image processing apparatus 1 may perform image processing for applying heat to a sheet on which an image is formed with decolorizing toner to erase the image on the sheet.

In the following, when referring to the relative position, direction, and the like in the image processing apparatus 1, words such as front, back, right, left, up, and down centering on the image processing apparatus 1 are used as long as there is no risk of misunderstanding. The right, left, up, and down respectively represent the right, left, up, and down of a person who stands in front of the image processing apparatus 1 and looks the rear of the image processing apparatus 1. Instead of the front, back, right, left, up, and down, the xyz Cartesian coordinate system shown in FIG. 1 is used in some cases. The xyz Cartesian coordinate system is a coordinate system fixed to the image processing apparatus 1. An x-axis of the xyz Cartesian coordinate system is an axis extending from the back to the front of the image processing apparatus 1 in the horizontal plane. The x-axis positive direction is a direction from the back to the front of the image processing apparatus 1. The x-axis negative direction is a direction opposite to the x-axis positive direction, of directions along the x-axis. A y-axis is an axis extending from the left to the right of the image processing apparatus 1 in the horizontal plane when viewed from the front to the back of the image processing apparatus 1. The y-axis positive direction is a direction from the left to the right of the image processing apparatus 1. The y-axis negative direction is a direction opposite to the y-axis positive direction, of directions along the y-axis. The x-axis and the y-axis are perpendicular to each other. A z-axis is an axis extending from the bottom to the top of the image processing apparatus 1. The z-axis is perpendicular to the x-axis and the y-axis. The z-axis positive direction is vertically upward. The z-axis negative direction is vertically downward.

The directions along the x-axis, the y-axis, and the z-axis are expressed as the x-axis direction, the y-axis direction, and the z-axis direction. The plane including the x-axis and the y-axis is the xy plane. The plane including the y-axis and the z-axis is the yz plane. The plane including the z-axis and the x-axis is the zx plane. Regarding the shape and posture of the respective members of the image processing apparatus 1, the shape and posture fixed to the image processing apparatus 1 will be described unless otherwise specified.

The operation device 10 includes a display 11 and a control panel 12. For example, the display 11 is an image display device such as a liquid crystal display and an organic EL (Electro Luminescence) display. The display 11 displays various types of information regarding the image processing apparatus 1.

The control panel 12 includes a plurality of buttons. The control panel 12 accepts an operation of an operator. The control panel 12 outputs, to the controller 27, a signal corresponding to the operation performed by the operator. The display 11 and the control panel 12 may be configured as an integrated touch panel.

The scanner device 15 reads, as light and dark, image information to be read. The scanner device 15 stores the read image information. The stored image information may be transmitted to another information processing apparatus via a network. The stored image information may be used by the printer device 20 for forming an image on a sheet.

The printer device 20 forms an image on a sheet on the basis of the image information generated by the scanner device 15 or image information received via a communication path. For example, the printer device 20 includes an image forming device, a fixing device, and a paper ejection device.

The image forming device includes a photoconductor drum, a charging unit, an exposure unit, a development unit, an intermediate transfer unit, a primary transfer roller, and a secondary transfer roller. The charging unit uniformly charges the photoconductor drum. The exposure unit irradiates the photoconductor drum with light to form an electrostatic latent image on the photoconductor drum. The development unit forms a toner image by adhering toner to the electrostatic latent image formed on the photoconductor drum and developing the electrostatic latent image. The toner image on the photoconductor drum is transferred to the intermediate transfer unit by the primary transfer roller. The transferred toner image is caused to move to a secondary transfer position by the intermediate transfer unit. The secondary transfer roller transfers the toner image on the intermediate transfer unit to the sheet that has reached the secondary transfer position.

The number of colors of the toner used for forming an image in the image processing apparatus 1 is one or more. In the case where toner of a plurality of colors is used, the photoconductor drum, the charging unit, the exposure unit, the development unit, and the primary transfer roller are provided corresponding to the toner of each color.

The fixing device fixes the toner image on the sheet by heating and pressurizing the toner image transferred onto the sheet. As a result, an image is printed on the sheet. The fixing device decolorizes, in the case where, for example, a sheet on which an image has been formed with decolorizing toner is fed, an image of decolorizing toner by heating and pressurizing the image of decolorizing toner. The paper ejection device ejects the sheet to which the toner image has been fixed by the fixing device to the outside of the image processing apparatus 1.

The cassette paper feed device 25 houses, in a cassette, a sheet to be used for image formation or image processing in the printer device 20. The cassette paper feed device 25 conveys the sheet housed in the cassette to the printer device 20. The cassette paper feed device 25 may include a plurality of cassettes.

The outer shape of the paper feed device 30 is a rectangular parallelepiped shape. The paper feed device 30 is installed in the lower part of the printer device 20 and on the right side of the cassette paper feed device 25. The paper feed device 30 houses a plurality of sheets inside. The paper feed device 30 conveys, on the basis of the operation from the operation device 10, a sheet in a conveying direction F and feeds the sheet to the printer device 20. In the paper feed device 30, the direction in which the sheet is conveyed toward the printer device 20 is the conveying direction F. At the start of conveying the sheet, the conveying direction F is the y-axis direction. Unless otherwise specified, the conveying direction F is the direction at the time of conveying the sheet.

As shown in FIG. 2 to FIG. 4, and FIG. 9, the paper feed device 30 includes a body 31, a first roller 33, a second roller 34, a third roller 35, a first drive device 36, a winding device 37, a first linear member 38, a second linear member 39, and an adjustment mechanism 40. The body 31 includes an outer casing 45 and an inner casing 46.

Figure 2:
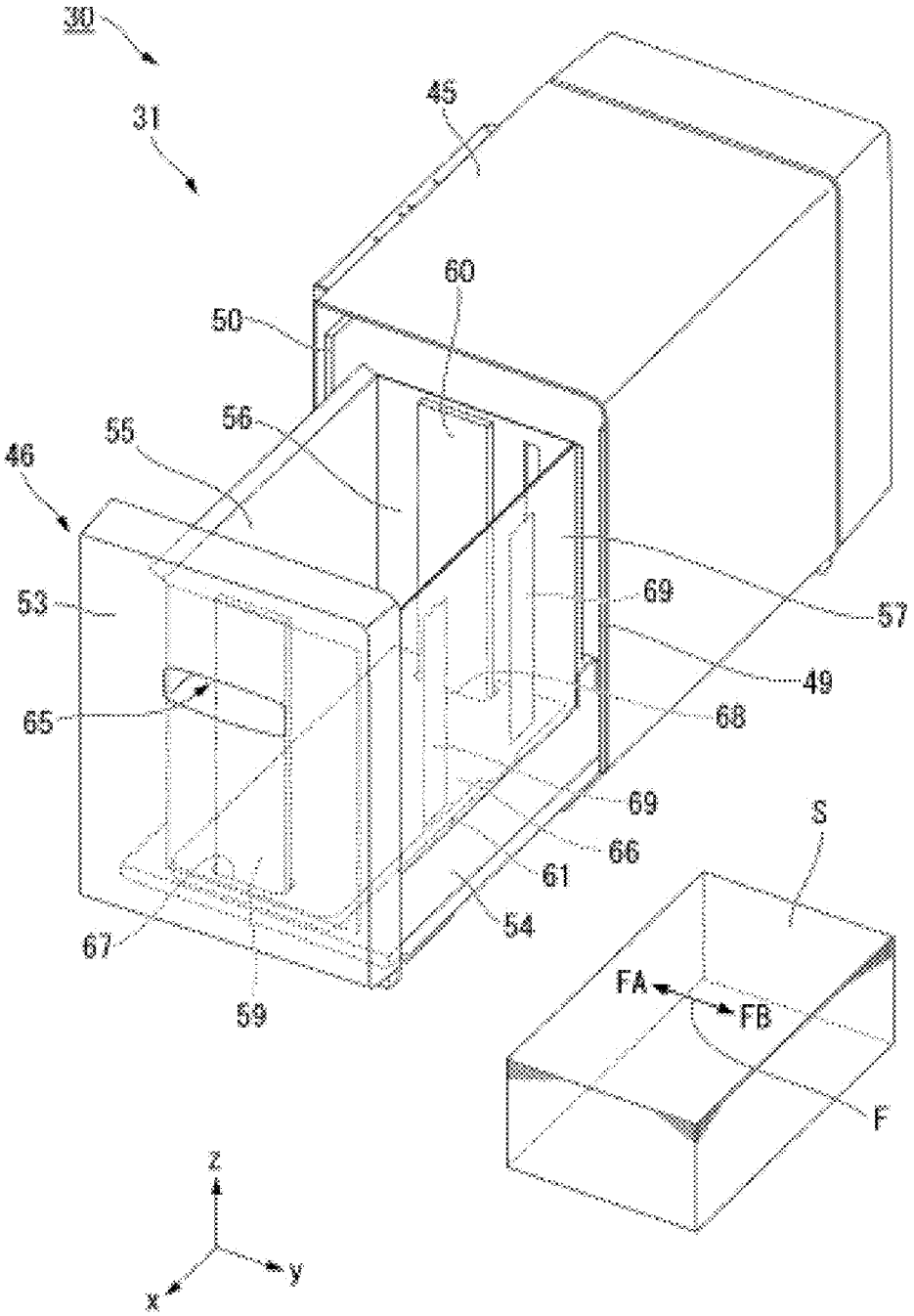
FIG. 2 is a perspective view showing a configuration example of the paper feed device according to the first embodiment.

As shown in FIG. 2, the outer casing 45 has a rectangular parallelepiped shape having an opening in the x-axis positive direction. A right frame 49 disposed parallel to the zx plane is provided near the inner surface the y-axis positive direction inside the outer casing 45. A left frame 50 disposed parallel to the zx plane is provided near the inner surface of the y-axis negative direction inside the outer casing 45. Lower ends of the right frame 49 and the left frame 50 are connected to each other by a lower frame parallel to the xy plane. Rear ends of the right frame 49 and the left frame 50 are connected to each other by a rear frame parallel to the yz plane.

The inner casing 46 includes a front cover 53, a bottom plate 54, a first support portion 55, a second support portion 56, a third support portion (second support member) 57, a first guide member 59, a second guide member 60, and a tray 61. The front cover 53 covers the opening of the outer casing 45 so as to be openable/closable. A handle 65 on which a hand is to be put when causing the front cover 53 to move in the x-axis direction is provided on the surface of the front cover 53 in the x-axis positive direction.

The bottom plate 54 is a plate member that is connected to the lower end of the front cover 53 and is capable of moving together with the front cover 53. The bottom plate 54 has a plate shape parallel to the xy plane. The first support portion 55 has a length in the z-axis positive direction from the end of the bottom plate 54 in the y-axis negative direction. The second support portion 56 has a length in the z-axis positive direction from the end of the bottom plate 54 in the x-axis negative direction. The second support portion 56 is connected to the end of the first support portion 55 in the x-axis negative direction. The third support portion 57 has a length in the z-axis positive direction from the end of the bottom plate 54 in the y-axis positive direction. The third support portion 57 is connected to the end of the second support portion 56 in the y-axis positive direction. The first, second, and third support portions 55, 56, and 57 have a U-shape that opens in the x-axis positive direction when viewed along the z-axis. The first, second, and third support portions 55, 56, and 57 are each formed of a steel plate or the like.

The first guide member 59 has a length in the z-axis positive direction from the end on the inner side than the end of the bottom plate 54 in the x-axis positive direction. The second guide member 60 has a length in the z-axis positive direction from the end on the inner side than the end of the bottom plate 54 in the x-axis negative direction and on the inner side than the second support portion 56.

The tray 61 has a flat plate shape. A support surface 66 that is an upper surface of the tray 61 is flat. The support surface 66 is formed of one member, i.e., the tray 61. A first through hole 67 and a second through hole 68 are formed in the tray 61. The tray 61 is disposed in the area that is on the bottom plate 54 and surrounded by the first, second, and third support portions 55, 56, and 57. The first through hole 67 is located at the end of the tray 61 in the x-axis positive direction. The first guide member 59 is provided in the first through hole 67. The second through hole 68 is located at the end of the tray 61 in the x-axis negative direction. The second guide member 60 is provided in the second through hole 68. As described below, the tray 61 is capable of entering a first state CH (see FIG. 5) and a second state CG (see FIG. 6).

Figure 5:
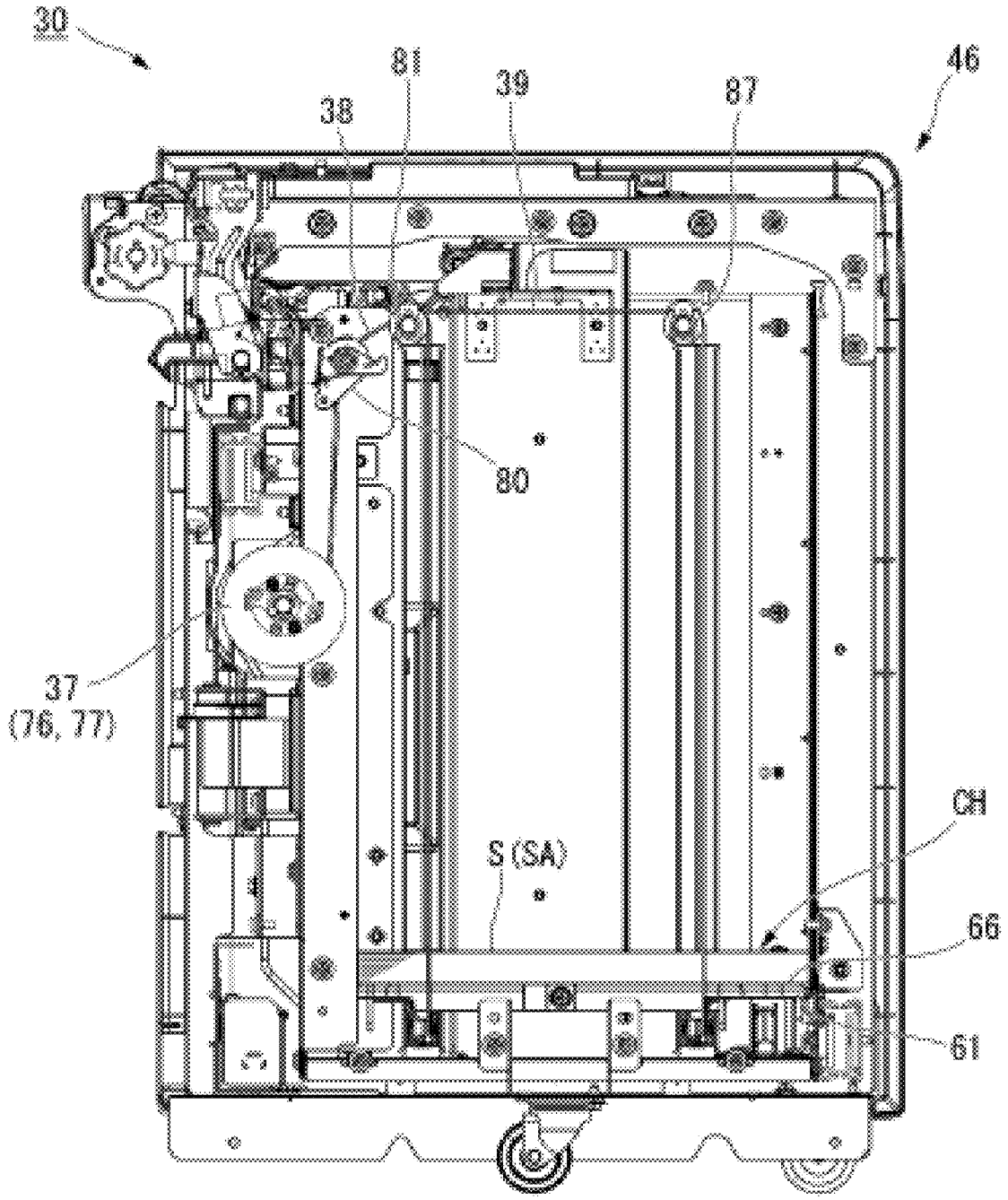
FIG. 5 is a cross-sectional view showing the paper feed device according to the first embodiment when a tray is in a first state.
Figure 6:
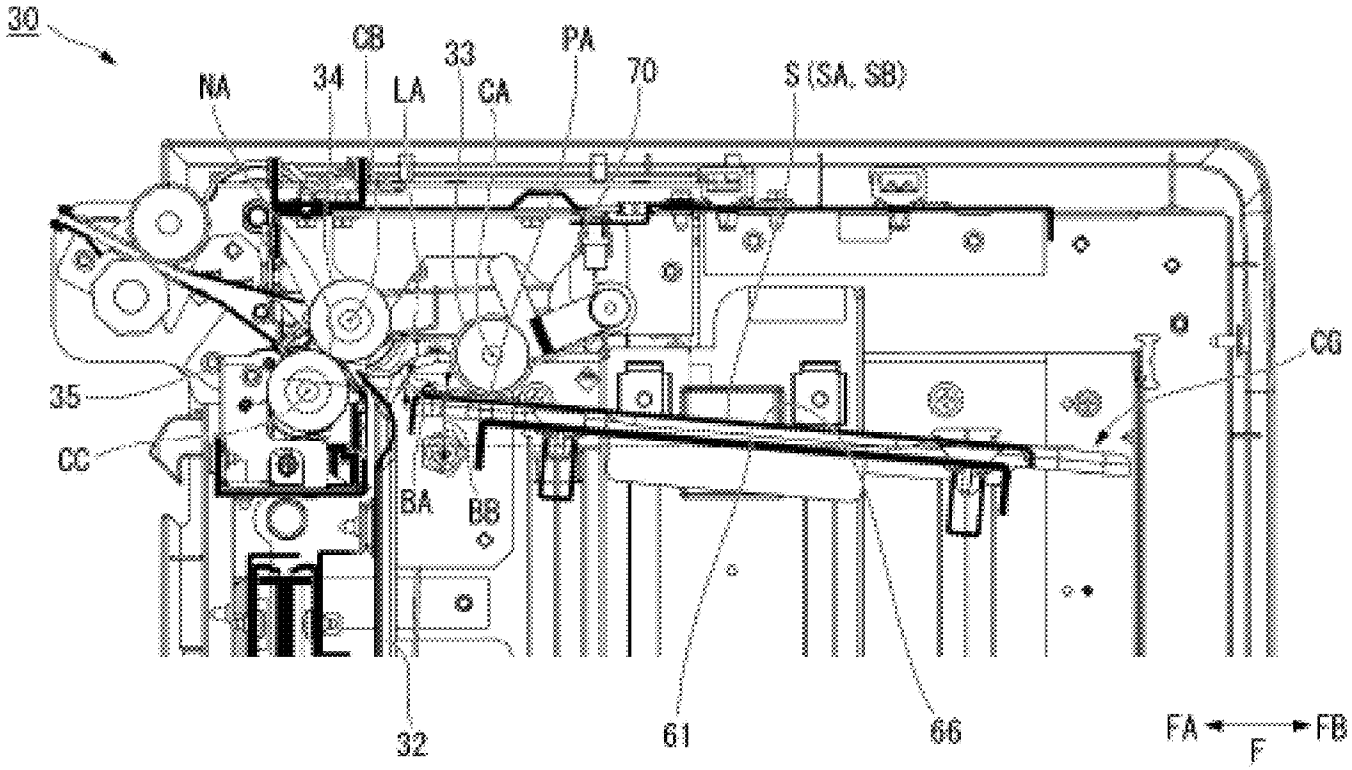
FIG. 6 is a cross-sectional view showing the paper feed device according to the first embodiment when the tray is in a second state.

The first state CH shown in FIG. 5 is a state for placing a sheet S on the support surface 66 of the tray 61 from the outside of the paper feed device 30. In the tray 61 in the first state CH, the support surface 66 is along the horizontal plane. The sheet S is placed on the support surface 66. Meanwhile, the second state CG shown in FIG. 6 is a state for taking out the sheet S from the support surface 66 toward a downstream side FA in the conveying direction F in which the sheet S is conveyed. Hereinafter, the side opposite to the downstream side FA in the conveying direction F will be referred to as the upstream side FB. However, the downstream side FA and the upstream side FB in the drawings conventionally indicate the orientations of the downstream side FA and the upstream side FB and are originally orientations with respect to the reference. The same applies also to the first side GA and the second side GB described below. The tray 61 in the second state CG puts the sheet S in an inclined posture heading upward on the downstream side FA than the upstream side FB. In other words, in the tray 61 in the second state CG, the support surface 66 is gradually inclined heading upward toward the downstream side FA. In the tray 61, the sheet S is placed on the support surface 66.

Figure 7:
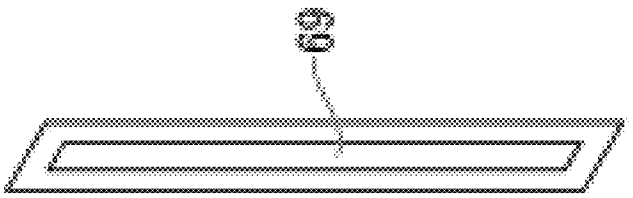
FIG. 7 is a perspective view showing a low-friction member in the paper feed device according to the first embodiment.

As shown in FIG. 2, the third support portion 57 is disposed on the upstream side FB than the sheet S placed on the support surface 66. The third support portion 57 supports the sheet S. As shown in FIG. 2 and FIG. 7, a low-friction member 69 is provided on the outer surface of the third support portion 57 facing the downstream side FA. For example, the low-friction member 69 is formed of PTFE (polytetrafluoroethylene resin). The dynamic frictional force between the low-friction member 69 and the sheet S is smaller than the dynamic frictional force between the third support portion 57 and the sheet S. In this embodiment, the low-friction member 69 has a length in the up-and-down direction and includes a plurality of low-friction members 69 in the third support portion 57. The plurality of low-friction members 69 is spaced apart from each other in the x-axis direction.

Figure 3:
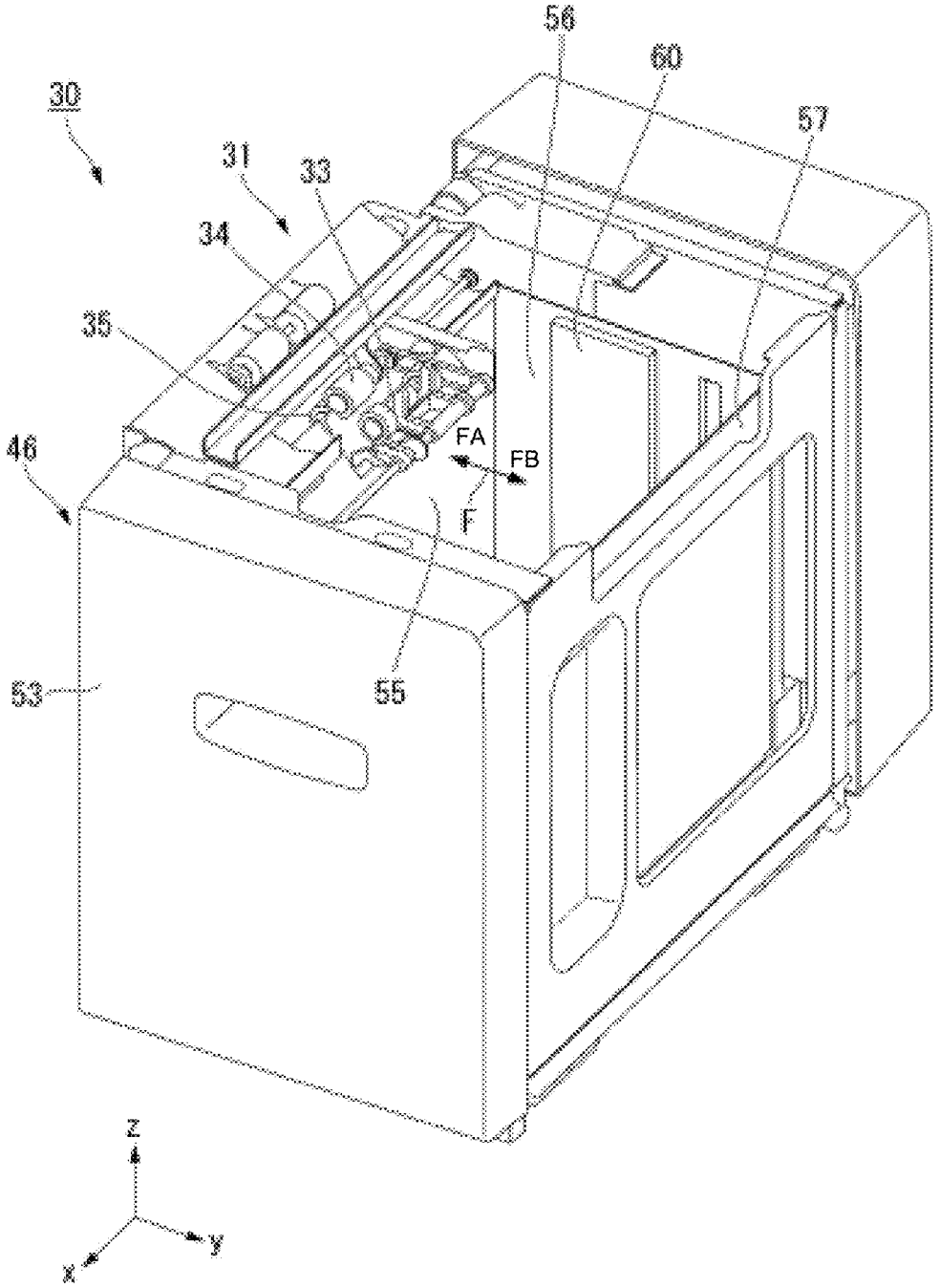
FIG. 3 is a perspective view showing an internal configuration on the left side of the paper feed device according to the first embodiment.

As shown in FIG. 3 and FIG. 6, the first, second, and third rollers 33, 34, and 35 each have a cylindrical shape. The first roller 33 is supported by an arm 70 so as to be rotatable about a rotation shaft CA of the first roller 33. For example, the first roller 33 is positioned such that the rotation shaft CA is along the horizontal plane. Note that FIG. 6 a cross-sectional view taken along the plane perpendicular to the rotation shaft CA of the first roller 33. The first roller 33 takes out the sheet S from the tray 61 toward the downstream side FA. Hereinafter, the position where the first roller 33 is in contact with the sheet S will be referred to as the contact position PA. The second roller 34 is located on the downstream side FA than the first roller 33. For example, the second roller 34 is positioned such that a rotation shaft CB of the second roller 34 is along the horizontal plane. The second roller 34 conveys the sheet S taken out by the first roller 33 to the downstream side FA. The second roller 34 is in contact with the first surface of the sheet S.

The third roller 35 is located below the second roller 34 so as to face the second roller 34. For example, the third roller 35 is positioned such that a rotation shaft CC of the third roller 35 is along the horizontal plane. The third roller 35 forms a nip NA sandwiching the sheet S between the third roller 35 and the second roller 34. The nip NA is disposed on the downstream side FA than the contact position PA and above the contact position PA. The third roller 35 is in contact with the second surface that is the back side of the first surface of the sheet S.

Now, the line connecting the contact position PA and the nip NA to each other is defines as the reference line LA (see FIG. 6). The angle between the reference line LA and the sheet S on the support surface 66 of the tray 61 in the second state CG (see FIG. 6) is an angle BA. The angle BA is an angle that is on the downstream side FA than the contact position PA and below the reference line LA. The angle between the reference line LA and the sheet S on the support surface 66 of the tray 61 in the first state CH (see FIG. 5) is an angle BB. The angle BA is smaller than the angle BB. The second roller 34 and the third roller 35 are rotatably supported by a support member 32 (see FIG. 6). For example, the support member 32 is formed of metal. The upper end of the support member 32 is gradually inclined on the downstream side FA toward upward. The upper end of the support member 32 is directed toward the nip NA.

Figure 4:
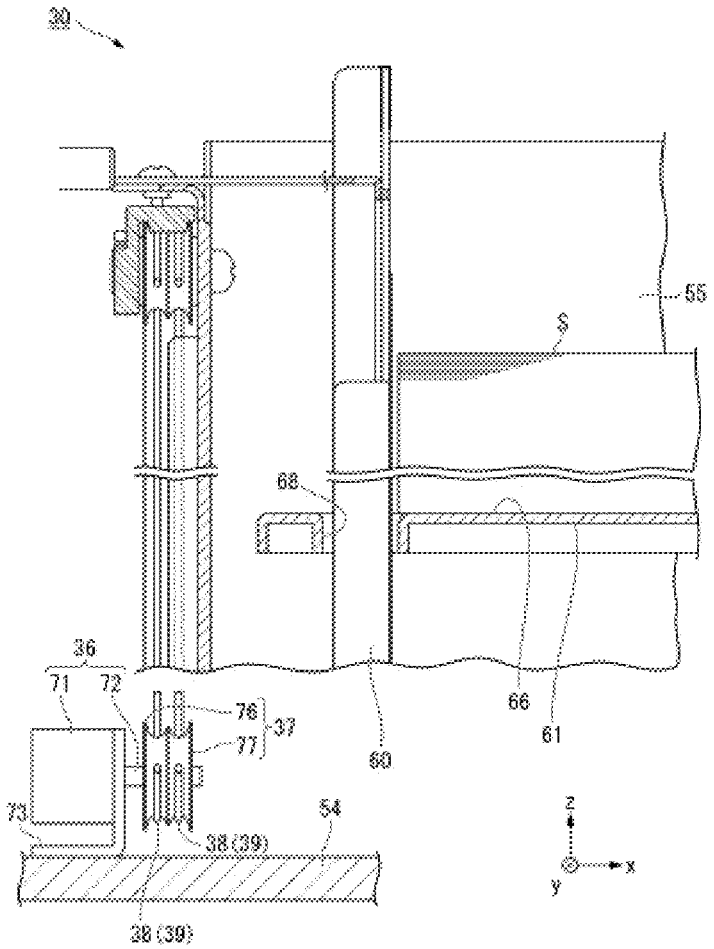
FIG. 4 is a cross-sectional view showing an internal configuration of the paper feed device according to the first embodiment.

The first drive device 36 supplies a drive force for raising and lowering the tray 61 in the up-and-down direction. As shown in FIG. 4, the first drive device 36 includes a body and a drive shaft 72. By applying a voltage in a predetermined orientation to the body 71, the body 71 causes the drive shaft 72 to rotate about the axis of the drive shaft 72. For example, the body 71 of the first drive device 36 is fixed to the bottom plate 54 via a fixture 73. The first drive device 36 is connected to the controller 27 and is controlled by the controller 27.

In this embodiment, as shown in FIG. 4, the paper feed device 30 includes, as the winding device 37, a first winding unit 76 and a second winding unit 77. The first winding unit 76 and the second winding unit 77 are pulleys having the same shape. The central portion in the width direction of each of the first winding unit 76 and the second winding unit 77 is recessed toward the inside in the radial direction. The first winding unit 76 and the second winding unit 77 are fixed to the drive shaft 72 of the first drive device 36 coaxially with the drive shaft 72. The winding device 37 may include only one pulley.

Figure 8:
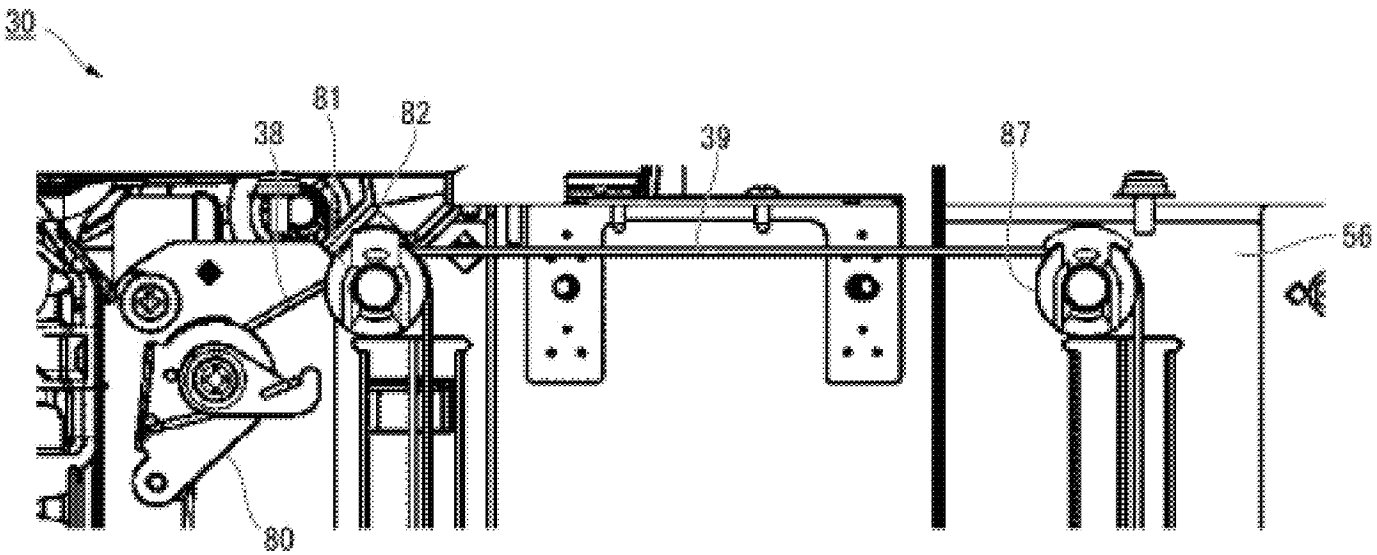
FIG. 8 is an enlarged view showing a main part of the paper feed device shown in FIG. 5.
Figure 9:
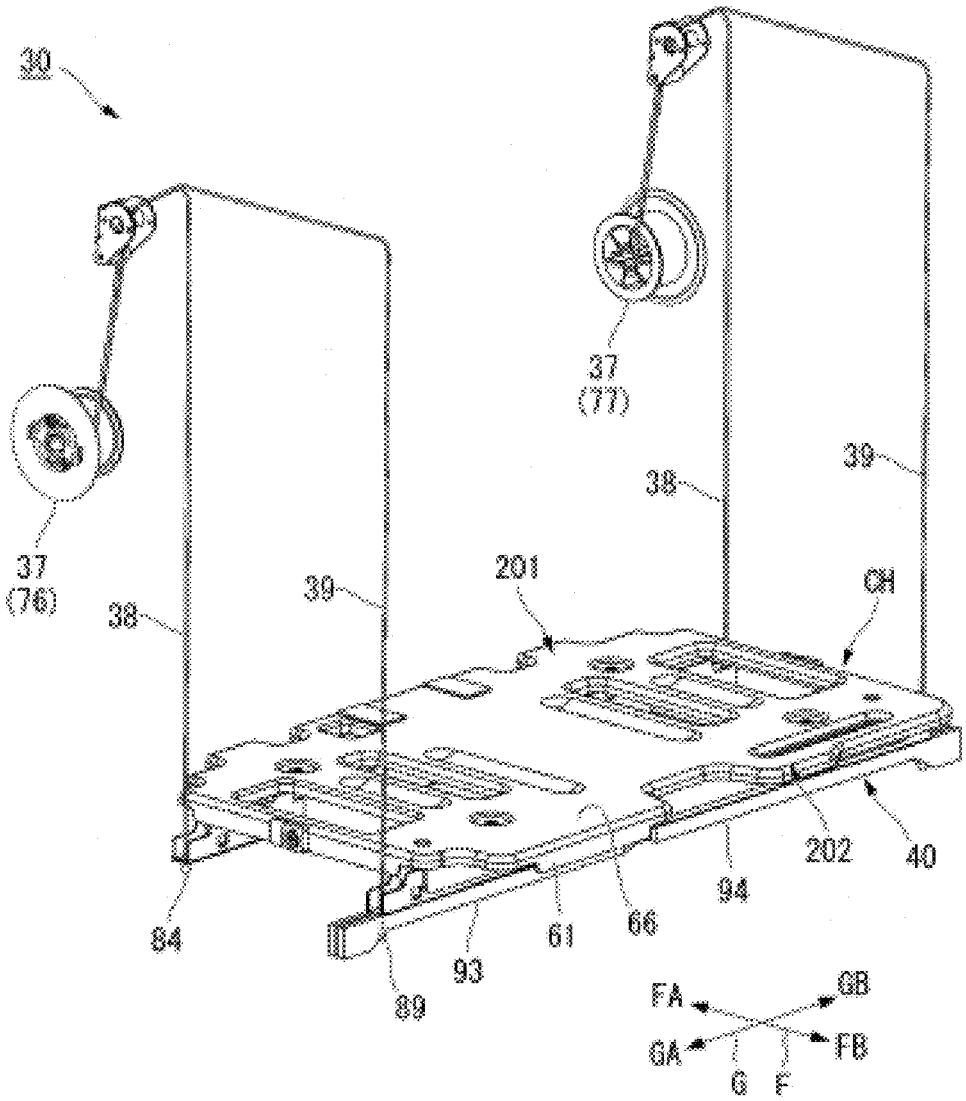
FIG. 9 is a perspective view showing the arrangement of the main part of the paper feed device according to the first embodiment.

For example, the first linear member 38 and the second linear member 39 are each a metal wire. The first linear member 38 and the second linear member 39 may be formed of nylon or the like. In this embodiment, the paper feed device 30 includes the first linear member 38. As shown in FIG. 4 and FIG. 5, one ends of the first linear members 38 are wound around the first winding unit 76 and the second winding unit 77. As shown in FIG. 5, the first linear members 38 are fed from the first winding unit 76 and the second winding unit 77 and routed by a tensioner 80 and a first intermediate pulley 81. The first linear member 38 wound around the first intermediate pulley 81 has a length downward from the first intermediate pulley 81. As shown in FIG. 8, a stopper 82 is fixed to the second support portion 56 or the like so as to cover the recess of the first intermediate pulley 81 from above. The stopper 82 prevents, when the first linear member 38 is loosened, the first linear member 38 from coming off from the first intermediate pulley 81. As shown in FIG. 9, a large-diameter portion 84 is provided at the other end (first end) opposite to one end of the first linear member 38. That is, the first linear member 38 includes the large-diameter portion 84. The large-diameter portion 84 has an outer diameter larger than those in the other portions of the first linear member 38.

As shown in FIG. 4, the paper feed device 30 includes a pair of second linear members 39. One ends of the second linear members 39 are wound around the first winding unit 76 and the second winding unit 77. As shown in FIG. 5, the second linear members 39 are fed from the first winding unit 76 and the second winding unit 77 and routed by the tensioner 80 and a second intermediate pulley 87. The second linear member 39 wound around the second intermediate pulley 87 has a length downward from the second intermediate pulley 87. As shown in FIG. 9, a support portion 89 is provided at the other end (second end) opposite to one end of the second linear member 39. That is, the second linear member 39 includes the support portion 89. The support portion 89 has an outer diameter larger than those in the other portions of the second linear member 39.

The large-diameter portions 84 of the pair of first linear members 38 are connected to a first portion 201 of the tray 61. For example, the first portion 201 is the end of the tray 61 on the downstream side FA. The large-diameter portions 84 of the pair of first linear members 38 are connected to the first portion 201 of the tray 61 so as to be spaced apart from each other in a first direction G that is along the horizontal plane and perpendicular to the conveying direction F. The first direction G is a direction along the support surface 66 of the tray 61. The first direction G may be the conveying direction F. The support portions 89 of the pair of second linear members 39 are located below the end of the tray 61 on the upstream side FB.

Figure 10:
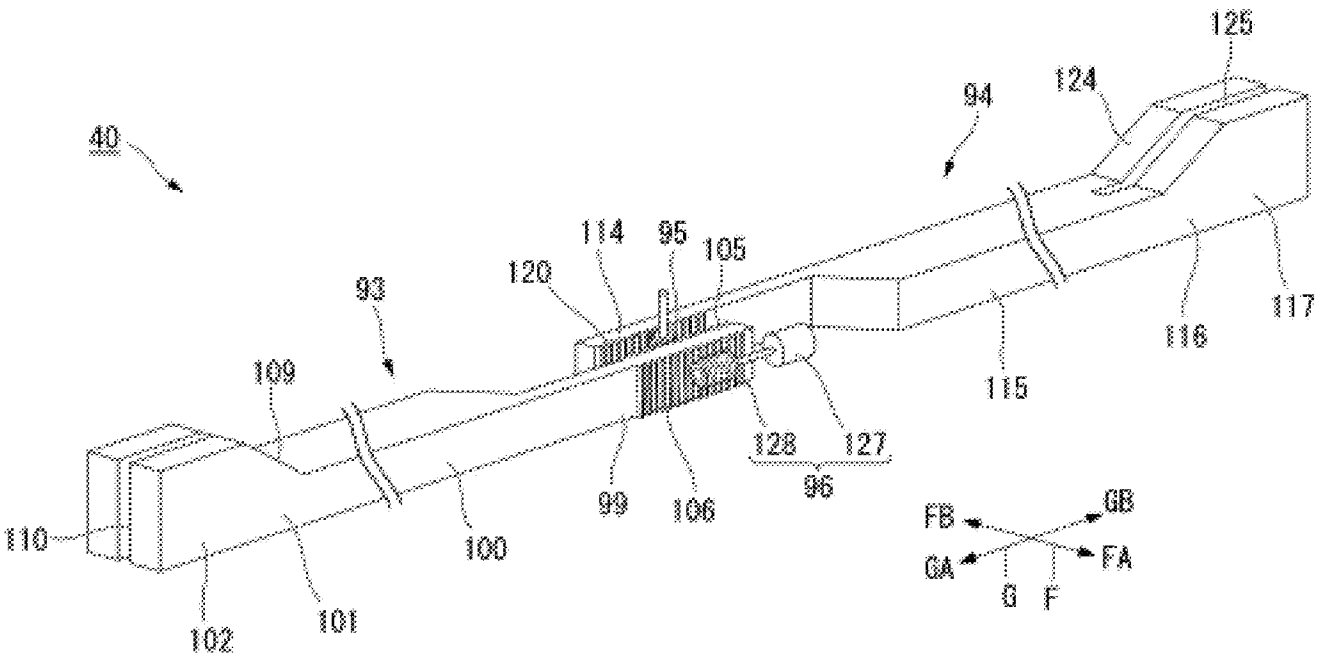
FIG. 10 is a perspective view showing an adjustment mechanism in the paper feed device according to the first embodiment.
Figure 11:
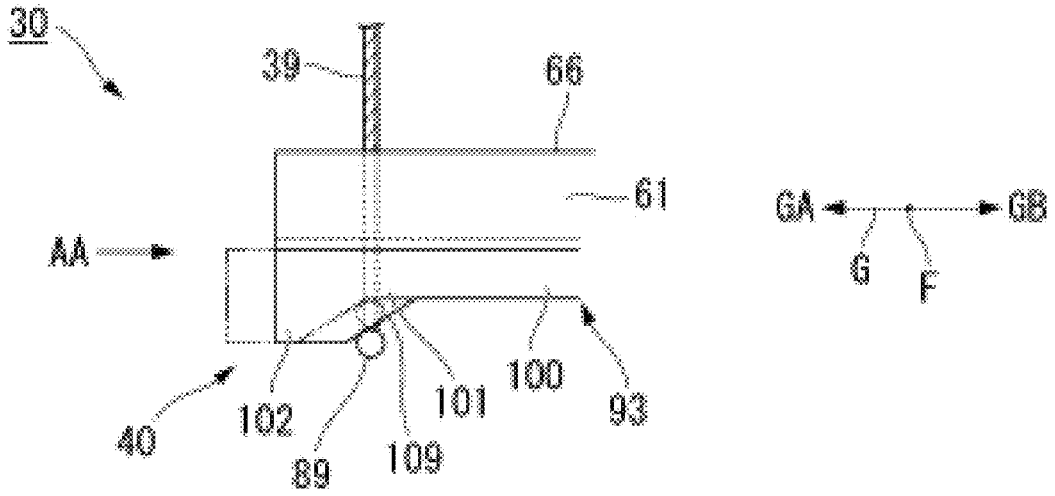
FIG. 11 is a front view showing a main part of the adjustment mechanism in the paper feed device according to the first embodiment.
Figure 12:
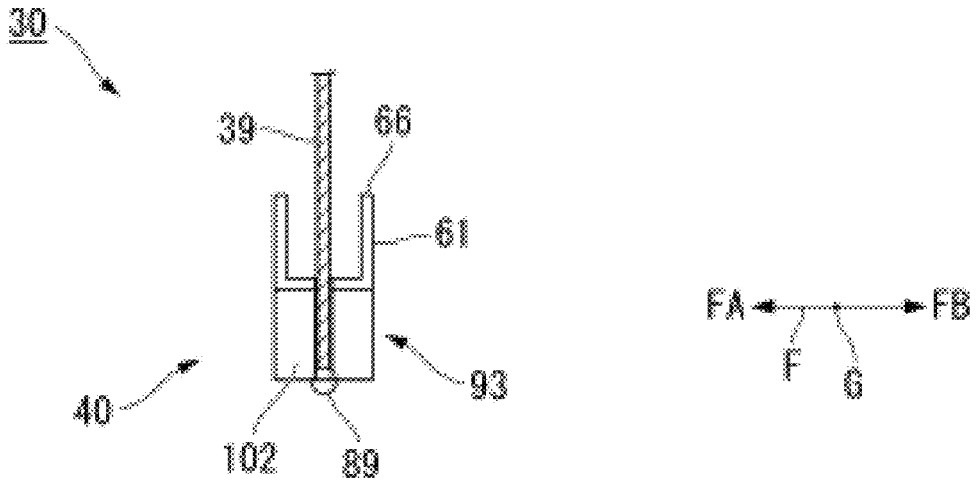
FIG. 12 is a view of the paper feed device shown in FIG. 11 as viewed from the AA direction.

As shown in FIG. 9, the adjustment mechanism 40 supports a second portion 202 of the tray 61 from below the second portion 202. The second portion 202 is the end of the tray 61 on the upstream side FB. The second portion 202 is located on the upstream side FB than the first portion 201 in the tray 61. As shown in FIG. 10, the adjustment mechanism 40 includes a pair of adjustment members 93 and 94, a pinion gear 95, and a second drive device 96. As shown in FIG. 10 to FIG. 12, the adjustment member 93 includes a narrow portion 99, a wide portion 100, an inclined portion 101, and a high-thick portion 102. The narrow portion 99, the wide portion 100, the inclined portion 101, and the high-thick portion 102 are located in this order from the central portion of the tray 61 in the first direction G toward the first side GA in the first direction G. Hereinafter, the first side GA in the first direction G will be referred to simply as the first side GA. The side opposite to the first side GA in the first direction G will be referred to as the second side GB. The narrow portion 99 has a rectangular parallelepiped shape having a length in the first direction G. a first rack gear 105 and a second rack gear 106 are respectively formed on the outer surfaces facing the upstream side FB and the downstream side FA in the narrow portion 99.

The wide portion 100 projects to the upstream side FB than the narrow portion 99. The inclined portion 101 gradually projects downward toward the first side GA. The surface facing downward of the inclined portion 101 is a locking surface 109. The locking surface 109 is gradually inclined downward toward the first side GA. The thickness of the high-thick portion 102 (length in the up-and-down direction) is similar to that of the thickest portion in the inclined portion 101. A slit 110 penetrating the high-thick portion 102, the inclined portion 101, and the wide portion 100 in the up-and-down direction is formed at the end on the first side GA of the high-thick portion 102, the inclined portion 101, and the wide portion 100. The slit 110 opens on the outer surface facing the first side GA of the high-thick portion 102. The width of the slit 110 (length in the conveying direction F) is larger than the diameter of the second linear member 39 and smaller than the diameter of the support portion 89.

A recessed and projecting fitting having a length along the first direction G is formed on the lower surface of the tray 61 and the upper surface of the adjustment member 93. The adjustment member 93 is provided on the lower surface of the tray 61 so as to be movable along the first direction G. The second linear member 39 is disposed in the slit 110. The support portion 89 of the second linear member 39 is locked to the locking surface 109 from below the locking surface 109. The support portion 89 supports the tray 61 via the adjustment member 93. The support portion 89 abuts on the second portion 202 of the tray 61 via the adjustment member 93. In order to connect the support portion 89 of the second linear member 39 to the adjustment member 93, the second linear member 39 is inserted through the slit 110 of the adjustment member 93. The support portion 89 of the second linear member 39 is locked to the locking surface 109.

The adjustment member 94 is configured in the same manner as the adjustment member 93 except for the second rack gear 106. As shown in FIG. 10, the adjustment member 94 includes a narrow portion 114, a wide portion 115, an inclined portion 116, and a high-thick portion 117 respectively configured in the same manner as the narrow portion 99, the wide portion 100, the inclined portion 101, and the high-thick portion 102 of the adjustment member 93.

A first rack gear 120 is formed on the outer surface facing the downstream side FA of the narrow portion 114. The wide portion 115 projects to the downstream side FA than the narrow portion 114. The inclined portion 116 gradually projects downward toward the second side GB. The surface facing downward of the inclined portion 116 is a locking surface 124. The locking surface 124 is gradually inclined downward toward the second side GB. A slit 125 penetrating the high-thick portion 117, the inclined portion 116, and the wide portion 115 in the up-and-down direction is formed at the end on the second side GB of the high-thick portion 117, the inclined portion 116, and the wide portion 115.

The adjustment member 94 is provided on the lower surface of the tray 61 so as to be movable along the first direction G. The second linear member 39 is disposed in the slit 125. The support portion 89 of the second linear member 39 is locked to the locking surface 124 from below the locking surface 124.

The pinion gear 95 engages with the first rack gear 105 of the adjustment member 93 and the first rack gear 120 of the adjustment member 94. The second drive device 96 includes a drive motor 127 and a worm gear 128. In the drive motor 127, the body causes a drive shaft to rotate. For example, the body of the drive motor 127 is fixed to the tray 61. The worm gear 128 is fixed to the drive shaft. The worm gear 128 engages with the second rack gear 106 of the adjustment member 93. The second drive device 96 is connected to the controller 27 and is controlled by the controller 27.

The adjustment mechanism 40 configured as described above operates as follows. For example, the worm gear 128 shown in FIG. 10 rotates in a predetermined direction, and the adjustment member 93 that engages with the worm gear 128 moves to the first side GA. The adjustment member 94 that engages with the adjustment member 93 via the pinion gear 95 moves to the second side GB. The locking surfaces 109 and 124 move so as to be separated from each other. The state of the locking surfaces 109 and 124 at this time is referred to as the surface separation state. Meanwhile, the worm gear 128 rotates in the orientation opposite to the predetermined orientation, and the adjustment member 93 that engages with the worm gear 128 moves to the second side GB. The adjustment member 94 that engages with the adjustment member 93 via the pinion gear 95 moves to the first side GA. The state of the locking surfaces 109 and 124 at this time is referred to as the surface approaching state. As described above, the second drive device 96 causes the pair of adjustment members 93 and 94 to move along the first direction G.

As shown in FIG. 9, when the tray 61 is in the first state CH, the locking surfaces 109 and 124 are in the surface approaching state. As shown in FIG. 11, the support portion 89 of the second linear member 39 is in contact with the corresponding lower end of the respective locking surfaces 109 and 124 of the pair of adjustment members 93 and 94. The distance in the up-and-down direction between the support portion 89 of the second linear member 39 and the tray 61 is relatively long, and the support portion 89 of the second linear member 39 is separated from the tray 61. At this time, the support surface 66 of the tray 61 is along the horizontal plane. As shown in FIG. 6, when the tray 61 is in the second state CG, the locking surfaces 109 and 124 are in the surface separation state. As shown by the two-dot chain line in FIG. 11, the support portion 89 of the second linear member 39 is in contact with the corresponding upper end of the respective locking surfaces 109 and 124 of the pair of adjustment members 93 and 94. The distance in the up-and-down direction between the support portion 89 of the second linear member 39 and the tray 61 is relatively short, and the support portion 89 of the second linear member 39 approaches the tray 61. In the tray 61, the support surface 66 is gradually inclined upward toward the downstream side FA.

As described above, in the paper feed device 30, when changing the state of the tray 61 from one of the first state CH and the second state CG to the other, the distance in the up-and-down direction between the support portion 89 of the second linear member 39 and the second portion 202 of the tray 61 is changed. As shown in FIG. 5, in the paper feed device 30, when the tray 61 is positioned at the lowermost position of the movable range of the tray 61, the tray 61 is in the first state CH. The locking surfaces 109 and 124 of the adjustment mechanism 40 are in the surface approaching state. While the tray 61 is caused to move upward by the first drive device 36, the state of the tray 61 is switched from the first state CH to the second state CG. At this time, the locking surfaces 109 and 124 of the adjustment mechanism 40 is in the surface separation state.

The controller 27 includes a CPU (Central Processing Unit) and a memory. The CPU executes the control program stored in the memory. The controller 27 controls the first drive device 36, the second drive device 96, and the like.

Next, the operation of the image processing apparatus 1 configured as described above will be described with an emphasis on the operation of the paper feed device 30. An operator pulls the inner casing 46 in the x-axis positive direction from the outer casing 45 of the paper feed device 30. As shown in FIG. 5, in the inner casing 46, thick paper SA that is a relatively thick sheet S, is placed on the support surface 66 of the tray 61. Since the support surface 66 is formed of one member, i.e., the tray 61, to be flat, it is possible to prevent the sheet S such as the thick paper SA from being broken or having a bending tendency. The operator pushes the inner casing 46 into the outer casing 45. The controller 27 causes the tray 61 to move upward by the first drive device 36. Specifically, the controller 27 increases the lengths of the first and second linear members 38 and 39 wound around the first and second winding units 76 and 77 by the first drive device 36.

Figure 13:
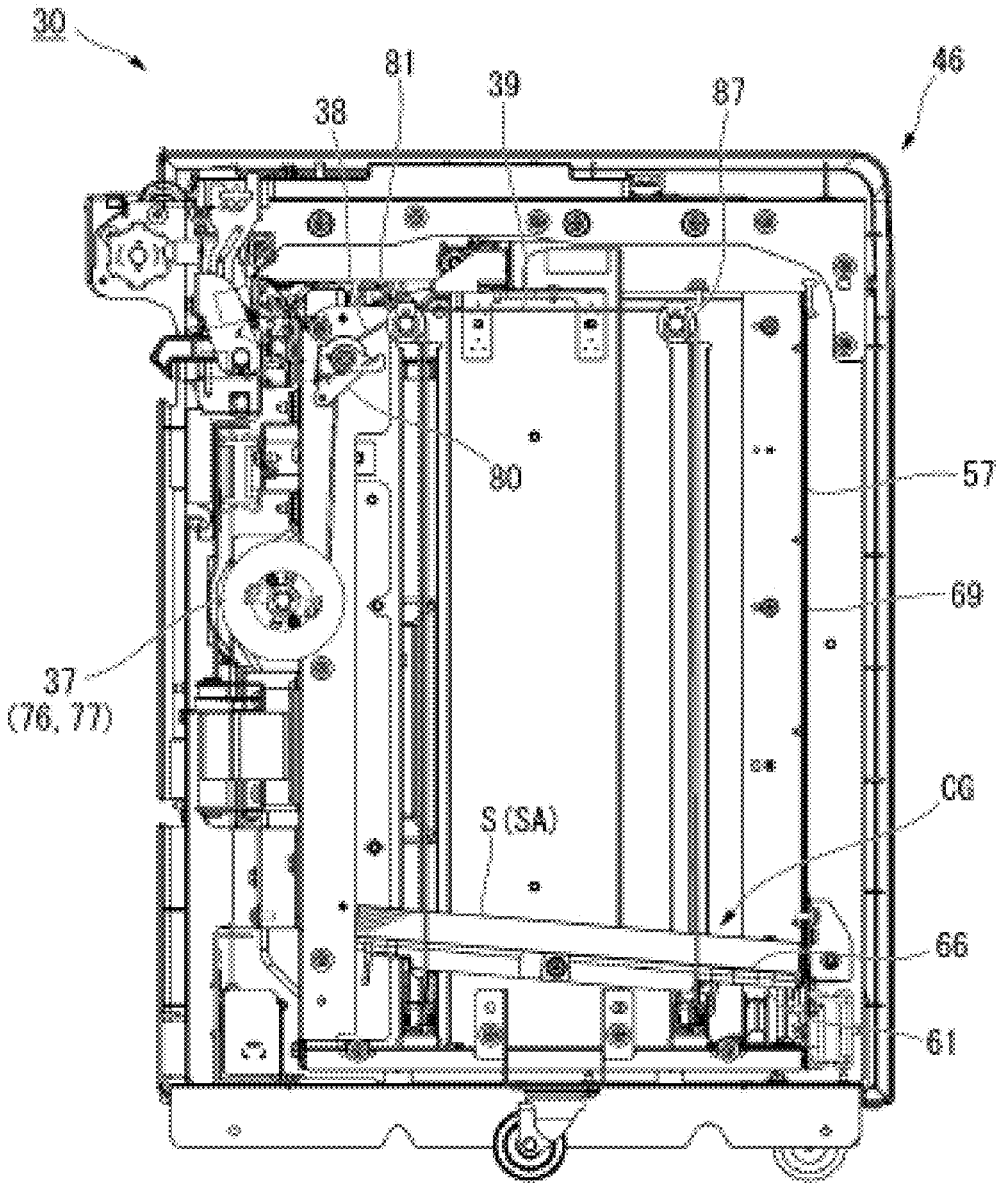
FIG. 13 is a cross-sectional view of the paper feed device according to the first embodiment when the tray is in the second state.

While the tray 61 is caused move upward, as shown in FIG. 13, the controller 27 switches the state of the tray 61 from the first state CH to the second state CG by the second drive device 96. Specifically, the controller 27 changes the state of the locking surfaces 109 and 124 from the surface approaching state to the surface separation state. The end of the tray 61 on the upstream side FB is lowered and the tray 61 enters the second state CG. Since the support surface 66 is inclined, the thick paper SA easily comes into contact with the low-friction member 69 of the third support portion 57. Since the dynamic frictional force between the low-friction member 69 and the thick paper SA is smaller than the dynamic frictional force between the third support portion 57 and the thick paper SA, the thick paper SA easily moves upward with respect to the low-friction member 69. As shown in FIG. 6, the thick paper SA on the support surface 66 of the tray 61 comes into contact with the first roller 33 from below the first roller 33. For example, the fact that the thick paper SA has come into contact with the first roller 33 can be detected by a sensor that detects the position of the arm 70.

Figure 14:
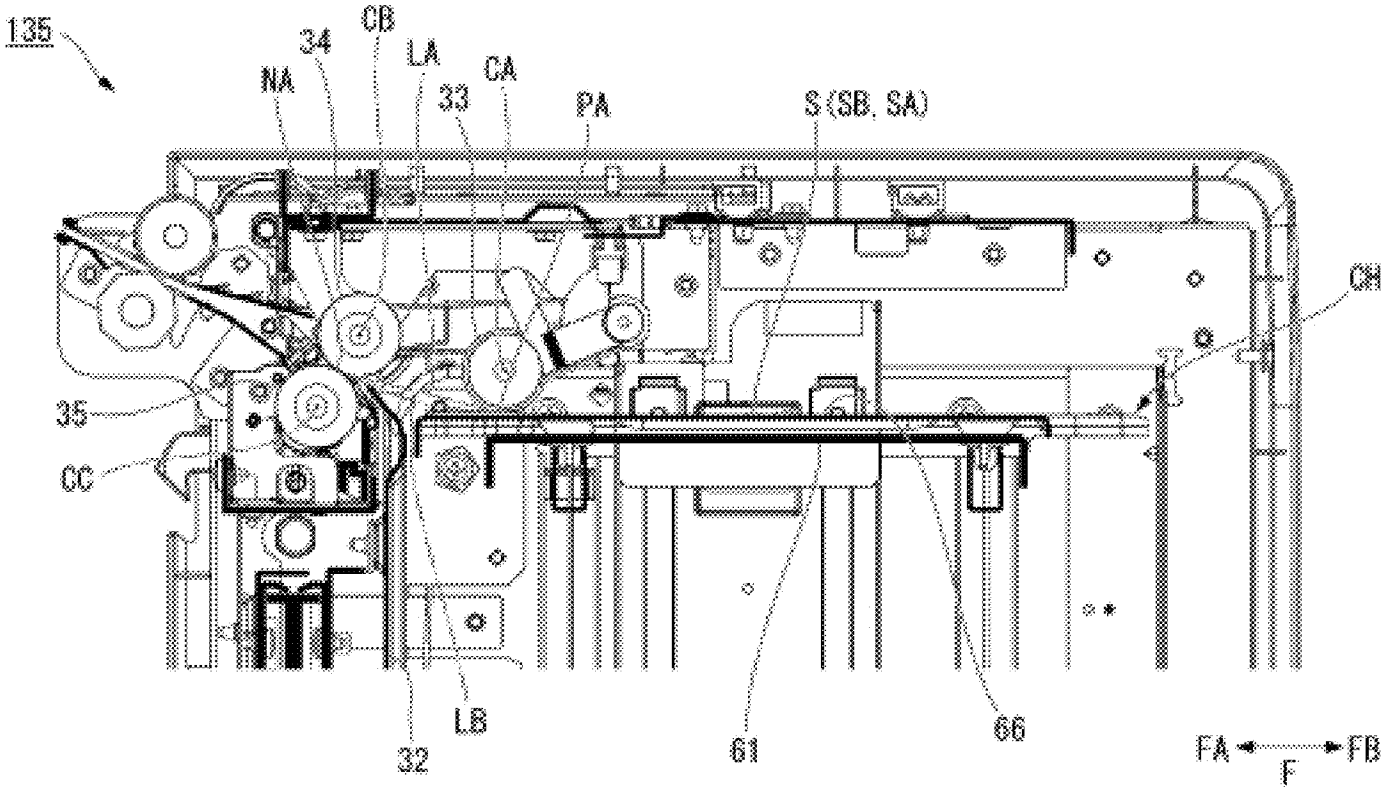
FIG. 14 is a cross-sectional view showing a main part of a paper feed device according to Comparative Example.

A paper feed device 135 according to a Comparative Example will be described with reference to FIG. 14. In the paper feed device 135, when the sheet S is taken out to the downstream side from the support surface 66, the tray 61 is in the first state CH. For example, in the case where the sheet S is thin paper SB that is relatively thin, the thin paper SB on the support surface 66 is conveyed to the downstream side FA along the support surface 66. The thin paper SB abuts on the support member 32. Since the thin paper SB has a relatively weak elasticity, the end of the thin paper SB on the downstream side FA deforms along the support member 32. The thin paper SB is guided to the nip NA while being curved to project downward as shown in a line LB of a two-dot chain line.

For example, in the case where the sheet S is the thick paper SA, the elasticity of the thick paper SA is relatively strong. Since the thick paper SA is hard to bend even if the thick paper SA abuts on the support member 32, the first roller 33 is easy to slip with respect to the thick paper SA. As a countermeasure, it is conceivable to urge the first roller 33 downward by an urging member such as a spring. When the first roller 33 is urged, the first roller 33 is hard to slip with respect to the thick paper SA. When the thin paper SB is used as the sheet S in this state, the thin paper SB is easily double-fed to the downstream side FA.

In the paper feed device 30 according to this embodiment shown in FIG. 6, when the sheet S is taken out from the support surface 66 to the downstream side FA, the sheet S is in the second state CG. For this reason, regardless of whether the sheet S is the thick paper SA or the thin paper SB, the sheet S is hard to abut on the support member 32 and the sheet S is reliably fed to the nip NA.

An image is formed by the printer device 20 on the thick paper SA guided to the nip NA. The thick paper SA is ejected by a paper ejection device.

As described above, in the paper feed device 30 according to this embodiment, the tray 61 is capable of entering the first state CH (see FIG. 5) and the second state CG (see FIG. 6). It is possible to easily place the sheet S on the support surface 66 of the tray 61 in the first state CH from the outside of the paper feed device 30. The angle BA between the reference line LA and the sheet S on the support surface 66 of the tray 61 in the second state CG is smaller than the angle BB between the reference line LA and the sheet S on the support surface 66 of the tray 61 in the first state CH (see FIG. 6). When the tray 61 enters the second state CG and the sheet S is taken out from the support surface 66 to the downstream side FA, the support surface 66 is further along the reference line LA. By providing no urging member to the first roller 33, it is possible to easily feed the thick paper SA to the nip NA and prevent the thin paper SB from being double-fed.

The paper feed device 30 includes the winding device 37, the first linear member 38, and the second linear member 39. The winding device 37 winds or feeds out the first and second linear members 38 and 39 to adjust the lengths of the first and second linear members 38 and 39. By adjusting the lengths of the first and second linear members 38 and 39, it is possible to cause the tray 61 to move in the up-and-down direction. By changing the distance between the support portion 89 of the second linear member 39 and the tray 61, it is possible to change the state of the tray 61 from one of the first state CH and the second state CG to the other. The paper feed device 30 includes the first drive device 36 and the adjustment mechanism 40. By adjusting, by the first drive device 36, the lengths of the first linear member 38 and the second linear member 39 fed out from the winding device 37, it is possible to cause the tray 61 to automatically move in the up-and-down direction.

As shown in FIG. 10 and FIG. 11, the adjustment mechanism 40 includes the adjustment member 93 and the second drive device 96. When the second drive device 96 causes the adjustment member 93 to move along the first direction G, the position in the up-and-down direction of the portion of the locking surface 109 with which the support portion 89 comes into contact changes. The second portion 202 of the tray 61 supported by the adjustment member 93 moves in the up-and-down direction with respect to the support portion 89. With a simple configuration of the adjustment member 93 and the second drive device 96, it is possible to change the distance between the support portion 89 of the second linear member 39 and the tray 61 in a continuous manner and configure the tray 61 to be capable of entering the first state CH and the second state CG. It is possible to change the inclination of the tray 61 in a continuous manner between the first state CH and the second state CG. The paper feed device 30 includes the third support portion 57 and the low-friction member 69. When the sheet S comes into contact with the low-friction member 69, e.g., when the sheet S enters the second state CG, the sheet S easily moves upward with respect to the low-friction member 69.

Note that the adjustment mechanism 40 does not necessarily need to include the adjustment member 94 and the pinion gear 95. In this case, the paper feed device 30 includes one first linear member 38 and one second linear member 39. The tray 61 moves in the up-and-down direction by transmitting the drive force of the first drive device 36 to the first linear member 38 and the second linear member 39. The paper feed device may include a gear instead of the first and second linear members 38 and 39. In this case, the tray 61 may move in the up-and-down direction by transmitting the drive force of the first drive device 36 to the gear.

Second Embodiment

Figure 15:
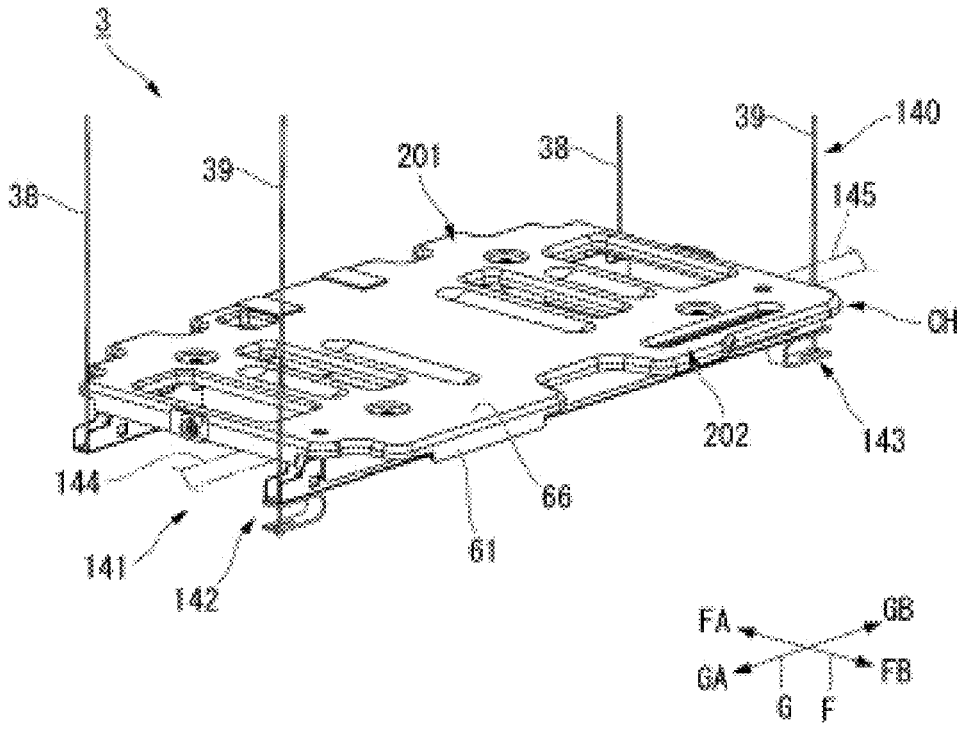
FIG. 15 is a perspective view showing the arrangement of a main part of a paper feed device according to a second embodiment.
Figure 16:
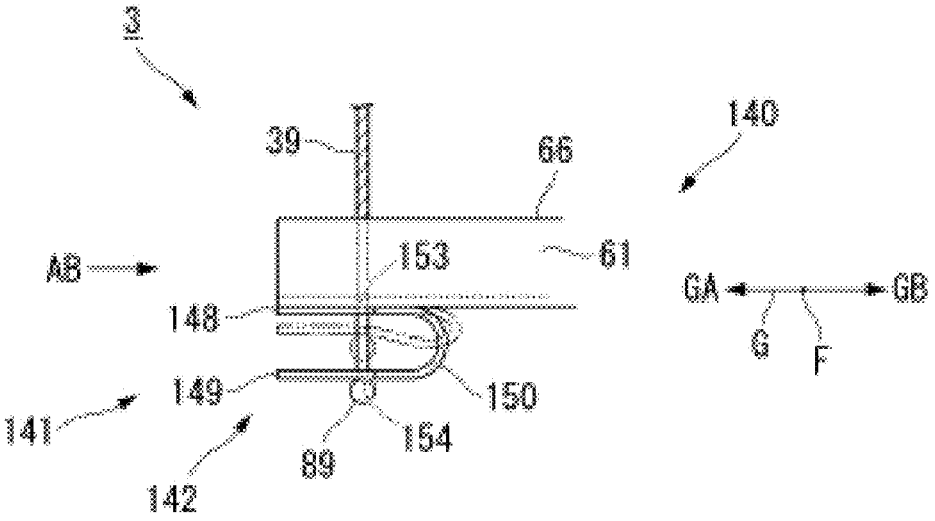
FIG. 16 is a front view showing a main part of an adjustment mechanism in the paper feed device according to the second embodiment.
Figure 17:
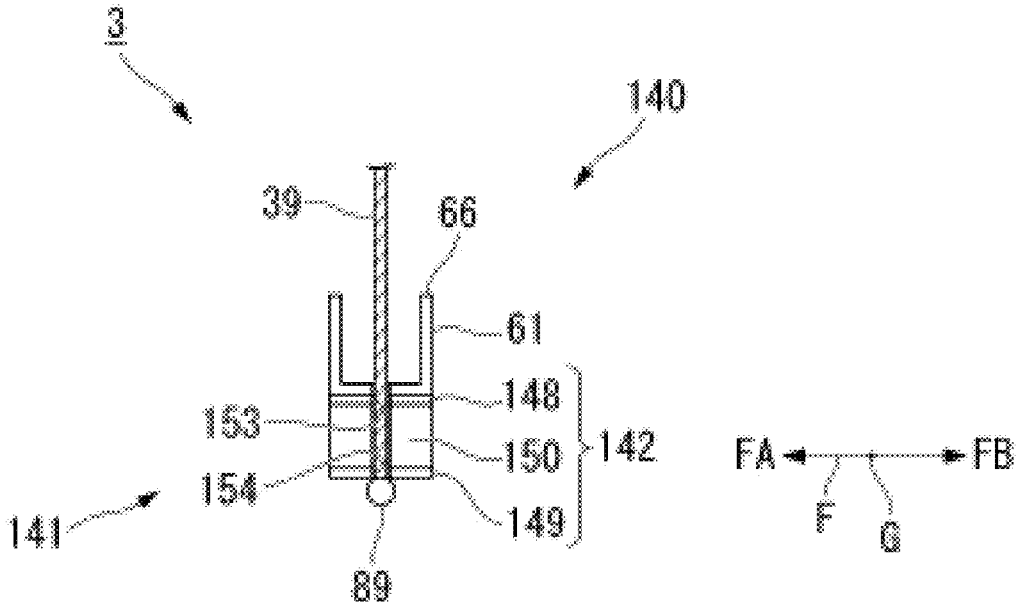
FIG. 17 is a view of the paper feed device shown in FIG. 16 as viewed from the AB direction.

Next, a second embodiment of the present invention will be described with reference to FIG. 15 to FIG. 17. The same parts as those in the embodiment described above will be denoted by the same reference symbols, description thereof will be omitted, and only differences will be described. As shown in FIG. 15 to FIG. 17, a paper feed device 140 according to this embodiment includes an adjustment mechanism 141 instead of the adjustment mechanism 40 of the paper feed device 30 according to the first embodiment. The paper feed device 140 is used in an image processing apparatus 3. The tray 61 shown in FIG. 15 to FIG. 17 is located at the lowermost position of the movable range of the tray 61 and is in the first state CH. The adjustment mechanism 141 includes a pair of spring members 142 and 143 and first support members 144 and 145. Note that in FIG. 15, the first support members 144 and 145 are shown by a two-dot chain line. The spring members 142 and 143 support the end of the tray 61 on the upstream side FB from below the end. The spring members 142 and 143 are provided on the lower surface of the tray 61. In this embodiment, the spring members 142 and 143 are torsion coil springs.

The spring member 142 has a U-shape in which the outside in the first direction G (the first side GA in this example) opens when viewed from the conveying direction F. As shown in FIG. 16 and FIG. 17, the spring member 142 includes a first arm portion 148, a second arm portion 149, and a connection member 150. The first arm portion 148 and the second arm portion 149 each have a flat plate shape and the respective thickness directions are along the up-and-down direction. The second arm portion 149 is located at a position separated downward from the first arm portion 148. The first arm portion 148 includes a slit 153 penetrating the first arm portion 148 in the up-and-down direction. The slit 153 opens to the first side GA. The width of the slit 153 (length in the conveying direction F) is larger than the diameter of the second linear member 39 and smaller than the diameter of the support portion 89. The second arm portion 149 includes a slit 154 penetrating the second arm portion 149 in the up-and-down direction. The slit 154 opens to the first side GA. The width of the slit 154 is larger than the diameter of the second linear member 39 and smaller than the diameter of the support portion 89.

The connection member 150 connects the end of the first arm portion 148 on the second side GB and the end of the second arm portion 149 on the second side GB to each other. The first arm portion 148, the second arm portion 149, and the connection member 150 configuring the spring member 142 are integrally formed by, for example, bending a steel plate.

The first arm portion 148 is fixed to the end of the tray 61 on the first side GA from below the end. The support portion 89 of the second linear member 39 abuts on the second arm portion 149 from below the second arm portion 149. The second linear member 39 is provided in each of the slit 153 of the first arm portion 148 and the slit 154 of the second arm portion 149.

As shown in FIG. 15, the spring member 143 is configured in the same manner as the spring member 142. The spring member 143 has a U shape in which the outside of the first direction G (the second side GB in this example) opens when viewed from the conveying direction F. The first arm portion of the spring member 143 is fixed to the end of the tray 61 on the second side GB from below the end. The support portion 89 of the second linear member 39 abuts on the second arm portion of the spring member 142 from below the second arm portion.

For example, the first support members 144 and 145 each have a flat plate shape. The first support members 144 and 145 are provided in the inner casing 46 of the body 31. The first support members 144 and 145 support the second portion 202 of the tray 61 in the first state CH from below the second portion 202. The first support member 144 supports the end of the tray 61 on the first side GA. The first support member 145 supports the end of the tray 61 on the second side GB. The first support members 144 and 145 support the second portion 202 of the tray 61 from below to cause the tray 61 to enter the first state CH.

Next, the operation of the paper feed device 140 configured as described above will be described. An operator places the thick paper SA on the support surface 66 of the tray 61. Since the second portion 202 of the tray 61 in the first state CH is supported by the first support members 144 and 145, the load due to the placing of the thick paper SA does not act on the spring members 142 and 143. The controller 27 causes the tray 61 to move upward by the first drive device 36. When the tray 61 is separated from the first support members 144 and 145, the load or the like acting on the tray 61 and the thick paper SA acts on the spring members 142 and 143. For example, the spring member 142 deforms such that the second arm portion 149 to which the support portion 89 is locked approaches the first arm portion 148 as shown by a two-dot chain line in FIG. 16. The second portion 202 of the tray 61 is lowered and the tray 61 enters the second state CG.

As described above, in the paper feed device 140 according to this embodiment, it is possible to easily feed out the sheet S to the nip NA when the sheet S is thick while suppressing the double-feeding when the sheet S is thin. The adjustment mechanism 141 includes the spring members 142 and 143 and the first support members 144 and 145. With a simple configuration of the spring members 142 and 143 and the first support members 144 and 145, it is possible to configure the tray 61 to be capable of entering the first state CH and the second state CG.

The adjustment mechanism 141 does not necessarily need to include the spring members 142 and 143. In this case, when the tray 61 is in the first state CH and is supported by the first support members 144 and 145, the portion of the second linear member 39 below the tray 61 is in a loosened state. The spring members 142 and 143 may be compression coil springs or the like. The adjustment mechanism 141 does not necessarily need to include the spring member 143 and the first support member 145.

Figure 18:
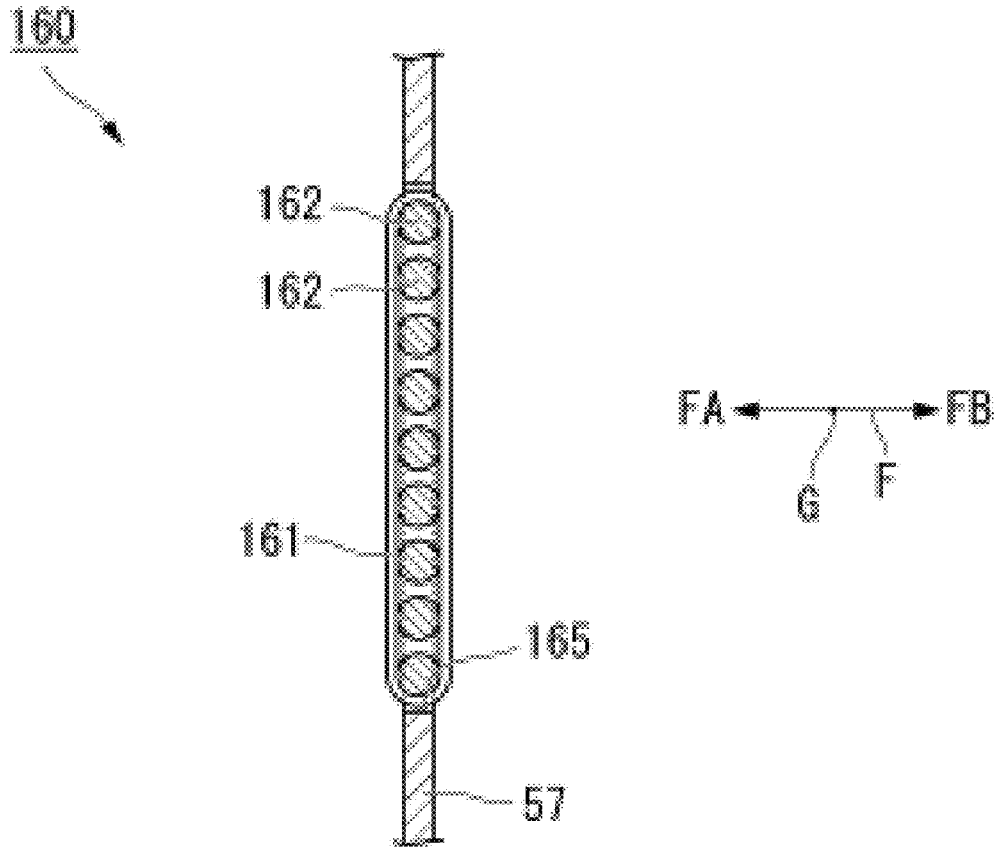
FIG. 18 is a cross-sectional view showing a main part of a paper feed device according to a modification of the embodiment.

As shown in FIG. 18, a paper feed device 160 may include an annular member 161 and a third support member 162 instead of the low-friction member 69 of the paper feed device 30 according to the first embodiment. In this modification, a through hole 165 is provided in the intermediate portion in the up-and-down direction of the third support portion 57. For example, the annular member 161 is an endless belt. The annular member 161 has a length in the up-and-down direction. The central portion in the conveying direction F of the annular member 161 is in the through hole 165. The portion (part) of the annular member 161 on the downstream side FA is on the downstream side FA than the third support portion 57. The portion of the annular member 161 on the upstream side FB is located on the upstream side FB than the third support portion 57. The entire annular member 161 may be located on the downstream side FA than the third support portion 57.

The third support member 162 has a round bar shape having a length in the first direction G. The paper feed device 160 includes a plurality of third support members 162. The plurality of third support members 162 is disposed so as to be spaced apart from each other in the up-and-down direction. The plurality of third support members 162 is located in the through hole 165. Both ends of the plurality of third support members 162 are attached to the peripheral edge of the through hole 165 in the third support portion 57. The plurality of third support members 162 is disposed in the annular member 161 and supports the annular member 161.

When the tray 61 enters the second state CG, the thick paper SA easily comes into contact with the annular member 161. The portion of the annular member 161 on the downstream side FA moves upward together with the thick paper SA. In this modification, the thick paper SA easily moves upward with respect to the third support portion 57.

In accordance with at least one of the embodiments described above, since the tray 61 is capable of entering the first state CH and the second state CG and the angle BA is smaller than the angle BB, it is possible to easily feed out the sheet S to the nip NA when the sheet S is thick while suppressing the double-feeding when the sheet S is thin.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A paper feed device, comprising:

a tray that has a support surface on which a sheet is placed and is capable of entering a first state and a second state, the first state being a state for placing the sheet on the support surface, the second state being a state for taking out the sheet from the support surface toward a downstream side in a conveying direction and for putting the sheet in an inclined posture heading upward on the downstream side in the conveying direction than an upstream side in the conveying direction;

a first roller that takes out the sheet from the tray to the downstream side in the conveying direction;

a second roller that conveys the sheet taken out by the first roller to the downstream side in the conveying direction;

a third roller that is provided to face the second roller and forms a nip sandwiching the sheet between the third roller and the second roller;

a drive device that causes the tray to operate to switch from one of the first state and the second state to the other, the drive device including:

a first drive device that causes the tray to move from one of a lower position for placing the sheet on the support surface and an upper position for taking out the sheet from the support surface to the other, and a second drive device that causes, in the first state, the tray to operate such that the support surface is horizontal and causes, in the second state, the tray to operate such that the support surface is inclined, the downstream side of the support surface in the conveying direction being located above the upstream side of the support surface in the conveying direction;

a first linear member that has a length toward the lower position and is connected to a first portion of the tray;

a second linear member that has a length toward the lower position, includes a support portion that supports the tray, and is disposed such that the support portion abuts on a second portion of the tray on the upstream side in the conveying direction than the first portion of the tray;

a winding device that is caused to operate by the first drive device to adjust the length of each of the first and the second linear member by winding or feeding out the first and the second linear members; and an adjustment mechanism that changes a distance in an up-and-down direction between the support portion of the second linear member and the tray, wherein an angle between a reference line and the sheet on the support surface of the tray in the second state is smaller than an angle between the reference line and the sheet on the support surface of the tray in the first state, the reference line connecting a contact position and the nip to each other, the first roller being in contact with the sheet at the contact position, a distance between the support portion of the second linear member and the second portion of the tray changes when a state of the tray is switched from one of the first state and the second state to the other, the tray enters the first state where the support portion of the second linear member is separated from the tray, the tray enters the second state where the support portion of the second linear member approaches the tray, the adjustment mechanism includes an adjustment member that is provided on a lower surface of the tray so as to be movable along the tray and has a locking surface, the support portion of the second linear member being in contact with the locking surface, the locking surface being inclined, and the second drive device causes the adjustment member to move along the tray.

2. The paper feed device according to claim 1, wherein the drive device causes, in the first state, the tray to operate such that the support surface is horizontal, and causes, in the second state, the tray to operate such that the support surface is inclined, the downstream side of the support surface in the conveying direction being located above the upstream side of the support surface in the conveying direction.

3. The paper feed device according to claim 1, further comprising a second support portion that is disposed on the upstream side in the conveying direction than the sheet placed on the support surface and supports the sheet placed on the support surface, and a plurality of low-friction members that has a length in a direction in which the tray is caused to move and is provided at intervals in the direction in which the tray is caused to move in the second support portion, a dynamic frictional force between each of the low-friction members and the sheet being smaller than a dynamic frictional force between the second support portion and the sheet.

4. The paper feed device according to claim 1, wherein the adjustment mechanism includes a spring member that is provided on a lower surface of the tray, the support portion of the second linear member abutting on the spring member from below the spring member, and a first support member that supports the tray from below the tray and causes the tray to enter the first state.

* * * * *